US005267674A

United States Patent [19]

von Schuckmann

[11] Patent Number: 5,267,674

[45] Date of Patent: Dec. 7, 1993

[54] CONTAINER FOR THE SPRAY-DISPENSING OF LIQUID

[75] Inventor: Alfred von Schuckmann, Kevelaer, Fed. Rep. of Germany

[73] Assignee: Robert Finke GmbH & Co. KG, Finnentrop, Fed. Rep. of Germany

[21] Appl. No.: 903,514

[22] Filed: Jun. 24, 1992

[30] Foreign Application Priority Data

Jun. 26, 1991 [DE] Fed. Rep. of Germany ..... 4121082
May 29, 1992 [JP] Japan ..... 4217865

[51] Int. Cl.[5] ..... B67D 5/40

[52] U.S. Cl. ..... 222/383; 222/396; 239/360

[58] Field of Search ..... 222/401, 400.8, 397, 222/383, 396; 239/355, 356, 360; 417/440, 443

[56] References Cited

U.S. PATENT DOCUMENTS 3,955,720 3/1976 Malone ..... 222/396

FOREIGN PATENT DOCUMENTS 0037496 10/1981 European Pat. Off. .
0075224 3/1983 European Pat. Off. .
689468 9/1930 France .
2068114 8/1971 France .

*Primary Examiner*—Jesús D. Sotelo
*Attorney, Agent, or Firm*—Martin A. Farber

[57] ABSTRACT

A invention relates to a container (1) for the spray-dispensing of liquid (2), having spray nozzle (D) arranged on the head side of the container (1) and a handle (14) for a pump (P) associated with the container, which pump has pump cylinder (6), piston rod (16) and pump cylinder for the production of a cushion of compressed air above the surface of the liquid (8), and, in order to obtain a structural shape which is free of residual pressure and avoids a springing back of the piston rod (16), the pump cylinder (6) at its lower end forms a pressure-relief opening (35) which can be moved over by the sealing surface of a cuff (22) which forms the pump piston, said opening being in flow communication with an outwardly open tube cross section (17) of the piston rod (16) when the pump piston (22) is in depressed position.

18 Claims, 5 Drawing Sheets

CONTAINER FOR THE SPRAY-DISPENSING OF LIQUID

FIELD AND BACKGROUND OF THE INVENTION

The present invention relates to containers for the spray dispensing of liquid, having a spray nozzle arranged on the top of the container and a handle for a pump which is associated with the container and has a pump cylinder, piston rod and pump piston for producing a cushion of compressed air above the surface of the liquid.

Dispensers of this type are extensively replacing spray devices which operate with propulsion agents which are environmentally objectionable. One device of this type is known, for instance, from U.S. Pat. No. 3,955,720, FIG. 12. The pump handle of the can be locked on the container in the basic position. The top or head surface of the container is provided for this purpose with a constriction having a detent groove developed on its inner side. The plate-shaped edge of the handle engages into said groove. In this way, any residual pressure remaining in the pump is prevented from lifting the pump handle out of the basic position and into an undefinable protruding position. Since the handle can pass into this locked position upon normal actuation of the pump already at the full stroke, this measure, however, proves troublesome since the handle must then be pulled out again with difficulty at a tubular connectorpiece which extends outward beyond the plate. All this impairs the operation of such propellant-free containers or dispensers. Furthermore, the action of heat can lead to such conditions of expansion that the internal pressure overcomes said detent means, resulting in creeping out and even in a protrusion which lifts off the protective cover. Accidental contact with articles contained in a bag can result unfavorably in the undesired release of the spray device. The passage of air into the inside of the container takes place furthermore at the bottom of the pump which extends from the top into the container. Depending on the level of filling, the air is forced through the liquid. This, as a rule, causes a gurgling noise. There is furthermore the disadvantage that, with the passage of time, liquid leaks outward over the air-feed path. This not only constitutes a loss but also decreases the acceptance of such dispensers.

The object of the present invention is to develop a dispenser of this type in a manner which is more favorable from the standpoint of use and handling while avoiding the abovementioned disadvantage of the springing back of the piston.

SUMMARY OF THE INVENTION

As a result of this development a container of this type for the spray dispensing of liquid is obtained which is of increased value in use. This result is obtained in the manner that the pump cylinder forms at its lower end a pressure-release opening which can be moved over by the sealing surface of a cuff which forms the pump piston, said opening, when the pump piston is in its depressed position, being in flow communication with a tubular cross section of the piston rod which is open towards the outside. The release of pressure is effected behind the rear of the piston body via the tubular cross section of the piston rod. The corresponding release of the pressure takes place suddenly. No special detent means which increase the cost of the system are required. The actuating handle nevertheless retains its basic position simply by the utilization of frictional force.

Another advantageous feature of the invention is that the cuff is clipped onto a central mandrel of the piston rod and a mushroom-shaped projection of the mandrel extends into the cup hollow of the cuff and has incisions which extend to the wall of the mandrel and are in flow communication with a passage. This assures the desired dependable valve function by extremely simple structural means. It is furthermore proposed that an encasing tube be placed over the pump cylinder, said tube being in clipped position with respect to the pump cylinder and forming the bottom of the pump cylinder. In this way, a separate bottom-forming structural part is unnecessary.

Another feature is that the cap bottom has an opening for the passage of the intake air through the tubular piston rod. The eccentric position of the grip-forming portion of the cap also restrains the user from holding the tubular piston rod closed. The desired feed of air is therefore always established upon pump movement. Furthermore, the development is characterized by an association of the cuff arranged on the end of the piston rod with a central passage so that it forms a sealing surface of an air-inlet valve as a result of relative displacement with respect to the piston rod, the corresponding valve-seat surface being formed by an annular rib of the piston rod the annular-rib diameter of which is larger than the central passage. In this way, the piston body forms at the same time a valve body.

It is furthermore proposed that the relative displacement consist of an axial displacement and that the bottom of the cup of the cup-shaped cuff close at least one inlet-valve passage hole in the region of the bottom of the piston rod. The pressure produced in the pumping direction in front of the piston pushes the cuff back and the rear of the latter applies itself against the other sealing surface. For an equally entitled distribution of the air drawn in upon the return stroke it is advantageous to provide several passage holes distributed at equal angles apart. One advantageous development is furthermore obtained by an encasing tube which surrounds the piston cylinder so as to form an air-guidance channel from the lower end of the pump up into the region of the upper part of the container, it terminating there as air-outlet opening. In this way, the compressed air which collects above the surface of the liquid is no longer forced gurgling through the liquid but is drawn very silently into the accumulator. The air assumes practically a U-shaped deflected path: entrance via the tubular piston rod, deflection at the lower end of the cylinder, and entrance into the return-air passage channel.

In order to prevent the liquid from flowing back into the region of the cylinder, the air-outlet opening of the air-passage channel is closed by an outlet valve which is arranged directly below the cover of the container. Here, also, the three-dimensional shape of the encasing tube is excellently utilized and the outlet valve is so shaped that it can be placed as cover body over the encasing tube. One useful further feature is that the cover body has a fastening collar which is clamped between a screw connection forming the pump single-hole and a pump-holding cap screwed thereon. The fastening collar serves in this connection at the same time as packing ring between said parts. The basic elasticity or flexibility of the material permits the further development that the cover body terminates in a valve lip comparable to a bicycle valve. The valve lip extends over the air-outlet opening.

It is furthermore found favorable for the pump handle to grip over the pump-holding cap. Such a solution is particularly saving in space and also has a stabilizing effect with respect to the actual gripping zone and the handle. Furthermore, it is advantageous for the pump handle and/or spray nozzle each to have individual holes to be used as filling openings which lie approximately in the centers of the narrow-side roundings of the container, which is of elongated cross section. The identically developed individual holes permit an optional attachment of cap elements. Therefore, for example, the pump having the handle can be attached, it always fitting regardless of what individual hole is in front of the mounting head. The same applies to the spray nozzle. The initial equipment creates in each case a differentiating means for the exact alignment of the other individual holes on the filling head. The functional part which is still lacking is then attached. Both individual holes can even be used simultaneously as filling openings. Therefore, minimum cycle times can be obtained in the filling line.

Due to the fact that the individual holes lie approximately in the centers of narrow-side roundings of the container, which is of elongated shape and cross section, the transport path can even be shortened, since the individual holes which are used as filling openings can be directed transverse to the direction of transport. On the other hand, if the alignment which is more favorable for the provision with the functional parts is to apply, it is advisable to move the container in the direction of its longest side in order to give the gripping tools, etc., the necessary space. Accordingly, there are properties which go far beyond the fundamental advantages of a container developed as a double bottle. With respect to the advantages in use, the said cross-sectional shape is more favorable than a cylindrical shape, since the corresponding cross section functions as advantageous safety against turning upon the initial filling as well as upon the subsequent filling. Such high holding forces as, for instance, in the case of a cylindrical container or container of rotational symmetry need not be applied. It also rests better in one's hand. The position of the individual holes in the vicinity of the narrow-side roundings is therefore an extremely logical place: on the one hand, the furthest possible distance apart of the functional parts from each other and, on the other hand, a concentrated, easily viewed arrangement of these functional parts upon use. Since the individual holes are developed on the container itself, the container can be established as a blow container. This is structurally simple and favorable from a price standpoint.

Furthermore, it is proposed that the pump handle and spray nozzle each be provided with a head part which interchangeably fits both individual holes. Such a head part can advantageously be developed as an integral element of the corresponding functional part and therefore, for instance, in the form of a screw ring, a screw cap or the like. The container-side attachment is then solved accordingly in equally advantageous manner in the manner that upward-facing screw connections extend from the cover. The corresponding polydirectionality of portions of the wall leads, despite the thinnest possible wall thickness, to an attachment base which is in itself very stable. The stresses coming from the movement of the pump are also taken up better.

Furthermore, the pump handle is developed as a cap which is turnable together with the pump piston rod and which has a downwardly open cavity to grip over the spray nozzle. In this way, the pump handle is imparted a double function since it, at the same time, forms a widened protective cap. Here, the substantially equally high neighboring position and the eccentric association of the pump piston rod, which now, at the same time, forms an axis for turning, are even measures of independent importance since they form an anti-turn lock in the end position of shortened length. The form-fitting engagement avoids any turning in this position. Only after intentional lifting of the cap can the latter be brought into protruding grip position, which facilitates the pump actuation, similar for instance to a hook grip of a walking cane. It is furthermore proposed that the base surface of the cap be geometrically similar to the head surface of the container. Such a cap rests readily in one's hand, corresponding to the selected cross-sectional shape of the container.

BRIEF DESCRIPTION OF THE DRAWINGS

The object of the invention is explained in further detail below with reference to two embodiments shown in the drawings, in which.

DETAILED DESCRIPTION OF THE PREFERRED EMBODIMENTS

Figure 1:
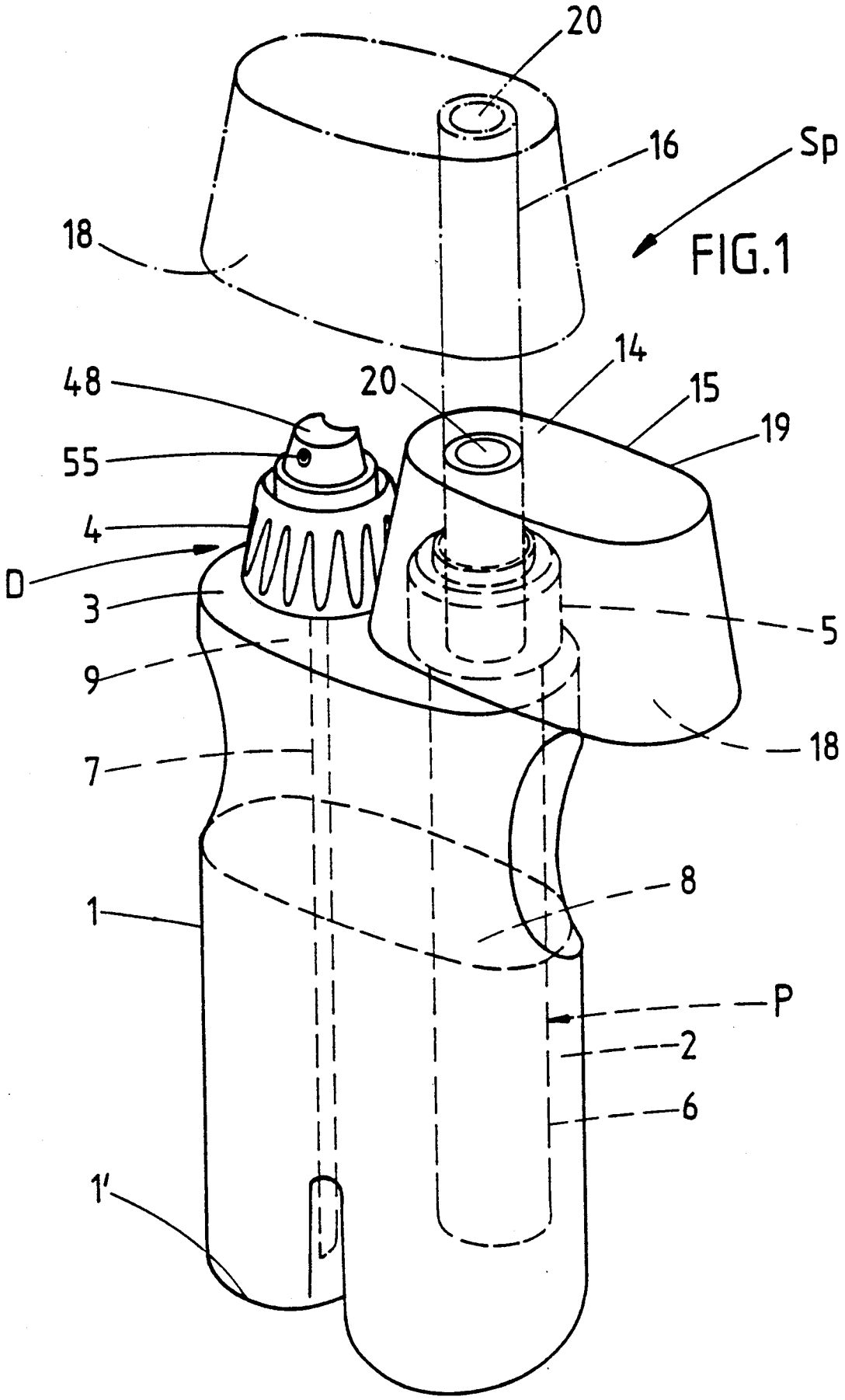
FIG. 1 shows the container developed as dispenser in a perspective view of the first embodiment, a protective cap at the same time forming the pump handle and being swung 180° out of the corresponding protective position.

The container 1 which is to be used as dispenser Sp is intended for the dispensing by spraying of liquid 2. For this purpose, it has a functional unit referred to as the spray nozzle D and a functional unit referred to as the pump P. The two of them are located, accessible for actuation, above a head surface 3 of the container 1, over which there extends a head part 4 of the nozzle D and a head part 5 of the pump P.

The container 1 is developed as a blow container. A pump cylinder 6, starting from the head part 5, extends into the inside of the container 1 almost to its bottom 1'. The bottom 1' is split so as to produce the impression of a sort of double bottle.

A riser tube 7, on the other hand, extends from the head piece 4 of the nozzle D parallel to the pump P.

Pump cylinder 6 and riser tube 7 extend over the predominant part of their length into the liquid 2, the surface of which lying in the upper third of the container 1 is designated 8.

For the passage of the corresponding functional units (P, D), there are two equally large, identically shaped individual holes 10 on the head surface 3, or, more precisely, in the container cover 9. These holes are extended upward to form correspondingly identically shaped threaded connections 11, through the external threads of which the head pieces 4, 5 are screwed.

The height of the threaded connections 11 corresponds approximately to half the inside diameter of the individual holes 10.

Figure 4:
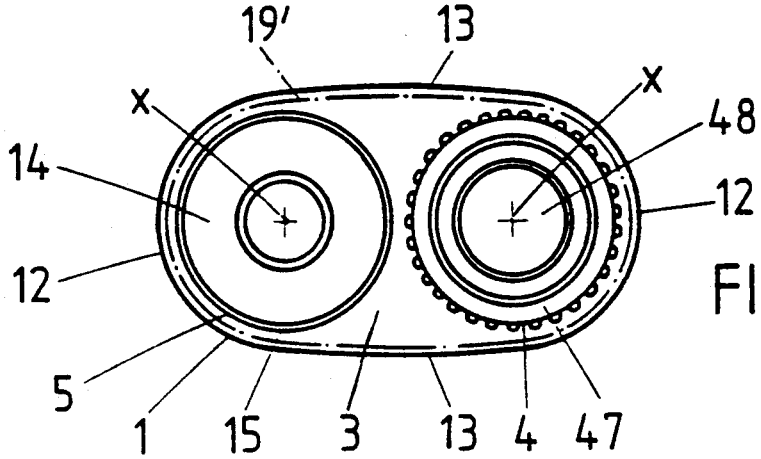
FIG. 4 is a top view thereof.

As can be noted from the drawings, particularly FIGS. 1 and 4, the individual holes 10 lie approximately in the centers x and x of narrow-side convex roundings 12 of the container 1 which is of elongated cross section. Reference is had, in particular, to FIG. 4. From it, it can also be noted that there is concerned an elliptical cross section the wide-side convex roundings of which are designated 13. Of course, an oval could also be concerned. Even a slightly concave depression of the wide-side roundings 13 would still fall within the character of the flat body of the container 1.

The identically shaped region of the individual holes 10 permits optional attachment of the pump P or spray nozzle D so that, upon the initial occupying of the one individual hole 10, the other individual hole then acts as filling opening and, vice versa, in which connection clear orientation features are already established by the corresponding initial attachment, as a result of which the filling opening can be positioned precisely in the filling line. Furthermore, both individual holes 10 can act simultaneously as filling openings depending on the existing situation, with corresponding subsequent attachment of the function units.

Figure 2:
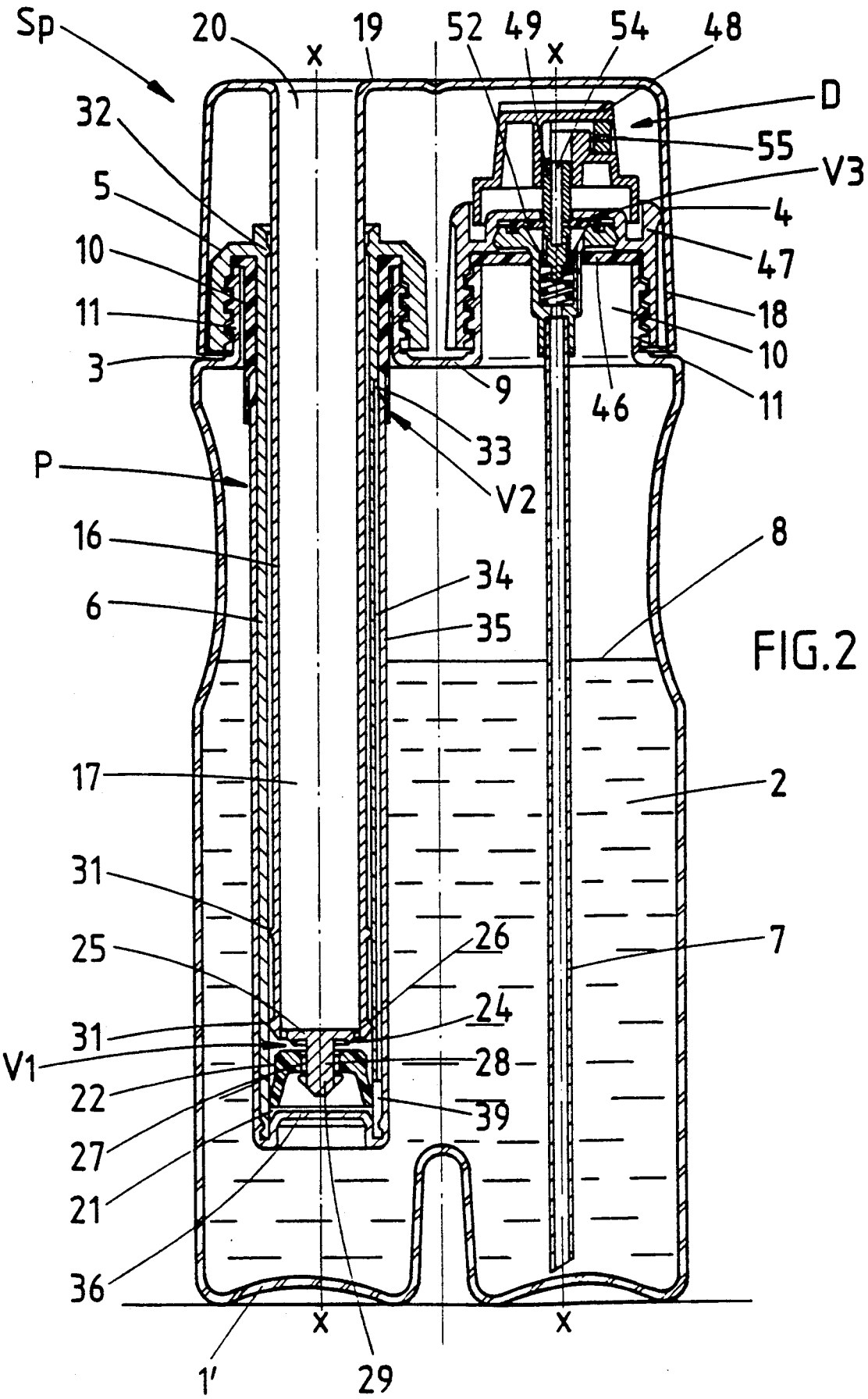
FIG. 2 is a vertical section through this dispenser in the basic position.
Figure 3:
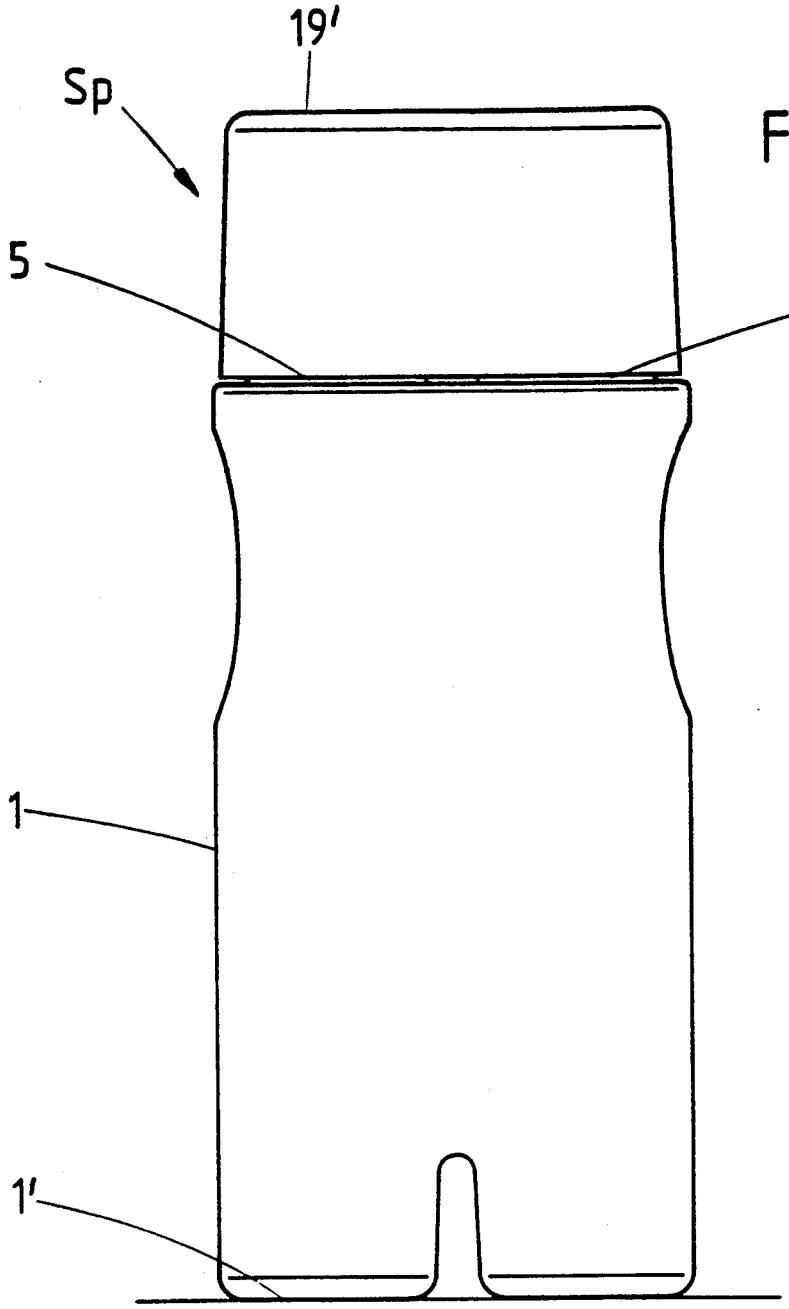
FIG. 3 shows the dispenser according to the second embodiment, seen in side view.
Figures 5, 6:
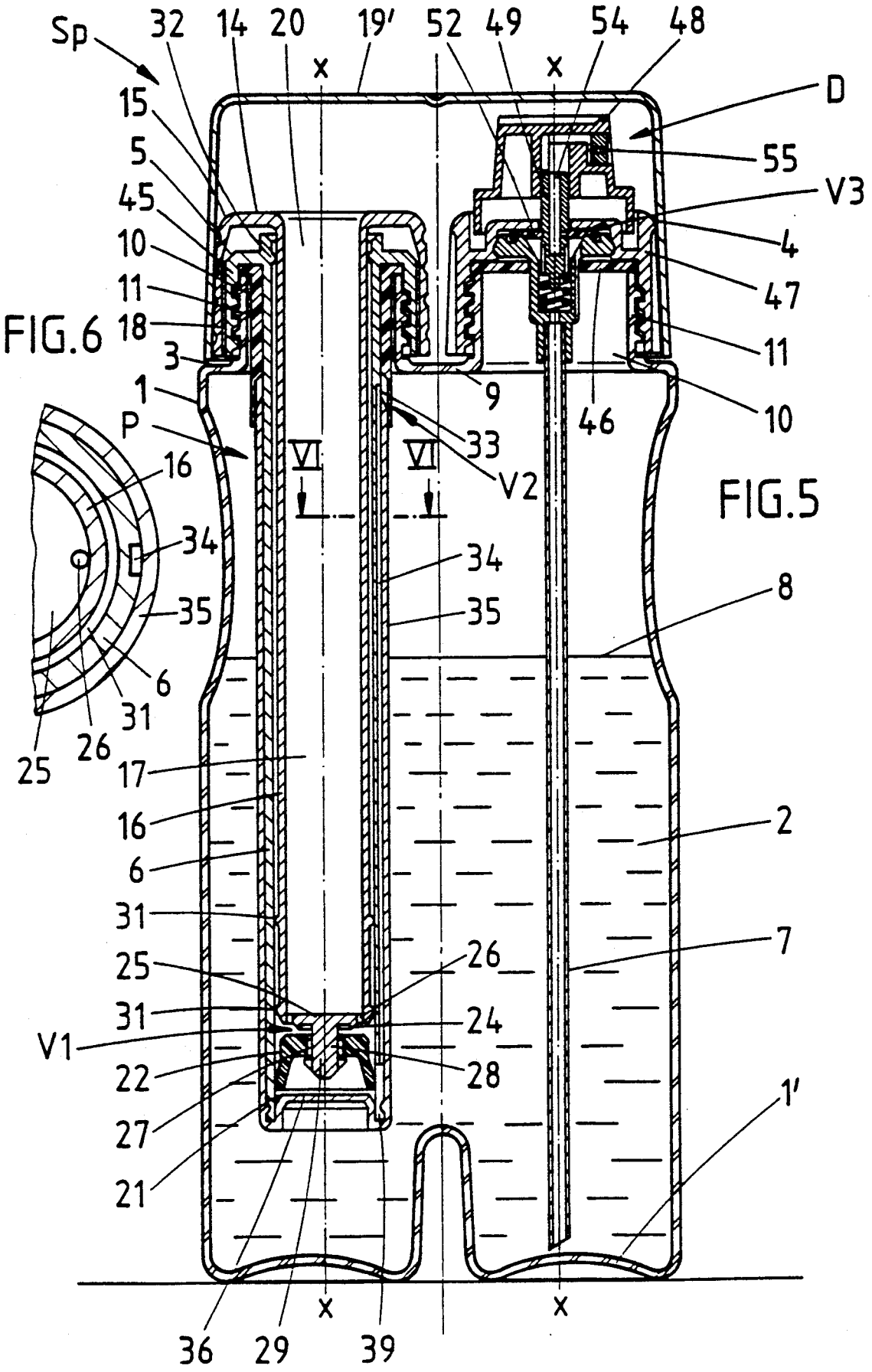
FIG. 5 shows this dispenser in a vertical section of the attached separate protective cap.
FIG. 6 is a section along the line VI—VI of FIG. 5.

The possibility of exchangeability which has been explained can be noted clearly from a comparison of FIGS. 1 and 2 and 1 and 5. In FIG. 1, the spray nozzle D is located on the left while in the other figure it is on the right.

The visible part of the functional unit "pump P" is its pump handle 14. The pump handle 14 is shaped differently in the two embodiments shown. In the second embodiment (for example, FIG. 5), the pump handle 14 passes into a cap 15 which grips as a protective cap over the head piece 5 of the pump P. The head piece 5 is in this case in the form of a pump-holding cap, i.e. screw cap, which is screwed onto the threaded connection 11 present there.

Figure 7:
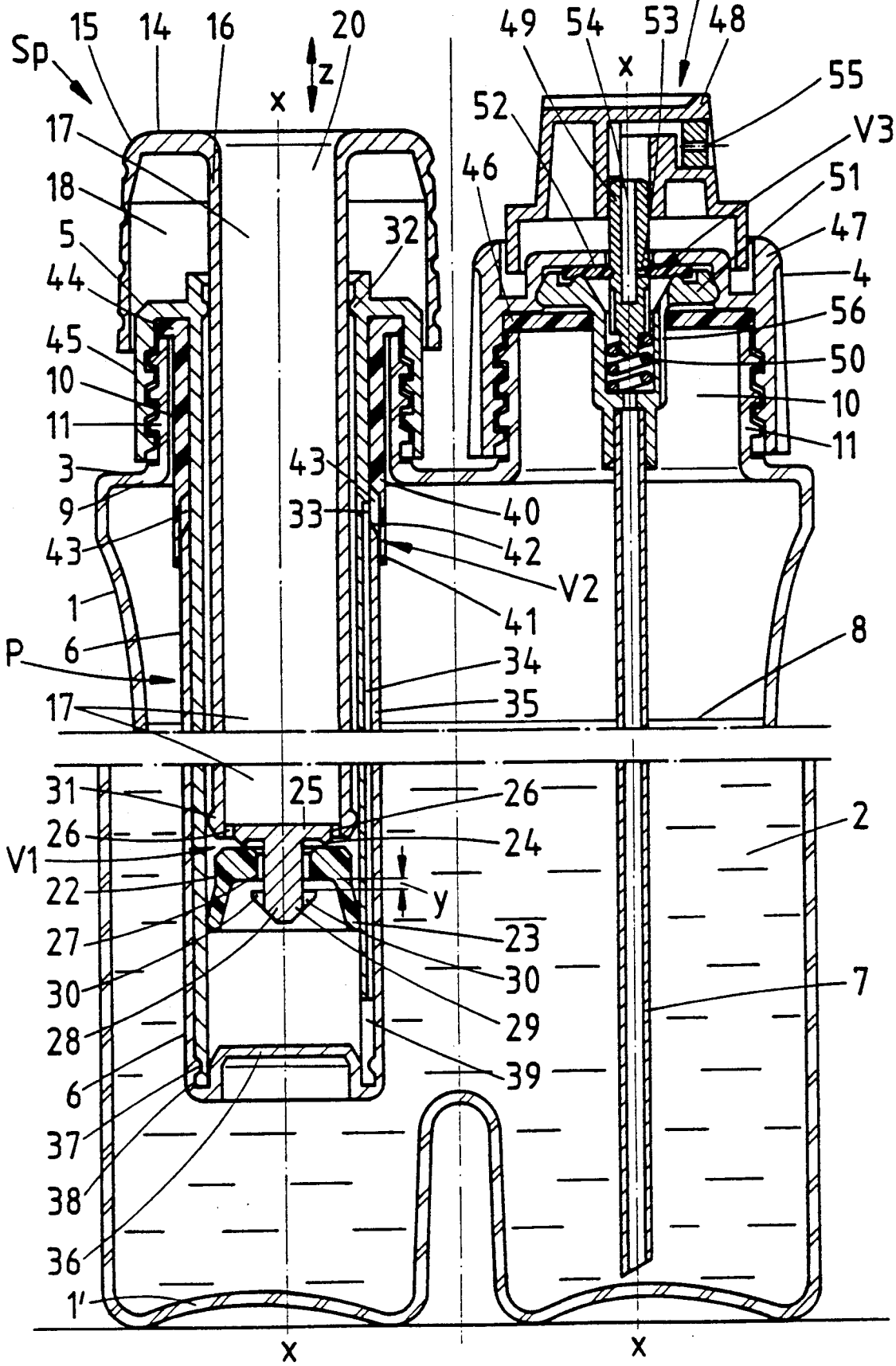
FIG. 7 is a section in accordance with FIG. 5 but on a larger scale and in pump-actuating position.

As can be clearly noted from FIG. 7, the cap 15 extends from the upper end of a tubular piston rod 16. It is an integral component of this piston rod 16 of circular cross section. It forms a downwardly open cavity 18 which is concentric to the tube cross section 17 of the piston rod 16. The downward facing edge of the circular cap 15 terminates directly in front of the head surface 3 of the container 1 when the piston rod 16 is in its basic position.

In the object in accordance with the first embodiment, a further function results with respect to the cap 15, in combination with a top cap 19 which protectively extends over both functional units, i.e. pump handle 14 and spray nozzle D, in the pushed-together basic position. This cap 19 extends in the same way as described from the upper end of the piston rod 16. It can be pulled, together with the piston rod 16, upward into the position of release shown in dash-dot line in FIG. 1. By turning it 180°, easily half of its contour extends over the elongated cross section of the container 1, namely in the length of the longer ellipse axis of the container. Naturally, a 90° rotation in one or the other direction is also sufficient, depending on what the person operating it considers more convenient. For right-handed persons or left-handed persons, individual possibilities of adjustment with regard to this exist. The cavity 10 which, in this case also, is open in downward direction, therefore releases the spray nozzle D by pulling the cap 15 in upward direction. The cavity is adapted to the conical shape of the head piece 4 so that by moving the cap 15 up, a substantially self-centering action is obtained. In this connection, the base surface or the edge of the cap 15 assumes a substantially congruent alignment with respect to the head surface 3 of the container 1. These surfaces are in any event substantially similar in their contour.

In both embodiments, the air forced into the inside of the container 1 is drawn in via the tubular cross section 17 of the piston rod 16. For this purpose, the bottom of the cap 15 leaves an opening 20 in both embodiments. The tubular cross section of the piston rod 16 is retained practically over the entire length thereof so that the transfer of the drawn-in air from the pump chamber 21 takes place in the region of the lower end of the pump cylinder 6. For this purpose, a piston is seated at the lower end of the piston rod 16. The piston is developed as a cuff 22. The edge of the cuff, which terminates in a sealing lip 23, forms a cup the opening of which faces downward. The sealing lip 23 slides over the inner wall surface of the pump cylinder 6.

The piston or cuff 22 acts at the same time also as air-inlet valve V1. For this purpose, the piston, which is formed of flexible or elastic material, is displaceable relative to the piston rod 16. The relative displacement is limited and designated by the free passage y in FIG. 7. Depending on the direction of movement of the piston rod 16, the bottom of the piston which is guided with frictional lock rests on its rear or front on the piston-rod side. In this way, the air passage is blocked or released.

Upon the forward stroke of the piston-rod 16, namely displacement in the direction of the reduction in size of pump chamber 21, the rear of the bottom of the cup rests against an annular rib 24 which is located concentrically to the longitudinal center axis of the piston rod 16 and is arranged on the end thereof. This rib forms a valve-seat surface. In this way, inlet-valve passage holes 26 arranged in the bottom region 25 of the piston rod 16 are closed. The individual inlet-valve passage holes 26 are distributed at an equal angle apart and extend in the vicinity of the inner wall of the tube cross section 17. The back of the cuff acts as sealing surface.

On the other hand, if the cup bottom of the piston 22 lifts off from said annular rib 24, as takes place by the pulling out of the piston rod 16, the path is free for the drawing in of the next portion of air, the inlet-valve passage holes 26 receiving flow communication with a central opening 27 in the bottom of the cup. The passage 27 is formed by corresponding clearance between the cuff 22 and a centrally lying mandrel 28 which axially guides it. The latter firmly adjoins the bottom side of the bottom region 25 of the piston rod 16 and terminates in a mushroom-shaped projection 29. The cuff 22 or piston is clipped onto this mandrel 28. The upward-facing lower side of the mushroom-shaped projection 29 creates the limiting stop in this direction for the piston, which is displaceable with the axial free path y.

For the release of the flow path upon the drawing-in process, the mushroom-shaped projection 29 has notch-like radially opening inclusions 30 which extend up to the wall of the mandrel. Despite the application of the lower end of the clip projection 29, the path through the pump chamber 21 is in this way always kept open. On the other hand, upon application against the annular rib 24, the aforementioned blocking of the flow path via the piston results since the diameter of the knife-shaped annular rib 24 is greater than the inside diameter of the central passage 27.

The piston rod 16 is connected in non-losable manner to the pump cylinder 6. For this purpose, there is a circumferential stop 31 in or close to the bottom region 25 on the outer wall of the piston rod 16, said stop cooperating with a mating stop 32 on the head piece 5.

Axially spaced from and substantially aligned with the bottom region 25 there is an additional annular rib 31 which, however, serves predominantly for guidance and, on the other hand, however, acts as second detent step. For the attaching and pulling out of the piston rod 16 an intentional act is required.

The air which passes via the inlet valve VI into the pump chamber 21 is conveyed from the lower pump end up into the region of the upper part of the container. For this purpose, the pump P has an air-outlet opening 33 directly below the container cover 9. This air-outlet opening 33 is controlled. An air-outlet valve V2 serves for this. The connection between the lower end of the pump P and the said air-outlet opening is produced by an air-passage channel 34. The latter is formed by a vertically longitudinally extending groove in the outer wall of the tubular pump cylinder 6. Reference is had to FIG. 6. The peripheral closing of the air-passage channel 34 is produced by an encasing tube 35 which is placed, resting well against it, on the pump cylinder 6. Said encasing tube 35 is substantially of beaker shape and by its bottom 36 forms the lower closure of the pump chamber 21. In the region of this bottom 36 there is provided a clip mounting in the manner that a clip projection 37 enters there into a corresponding groove on the outer surface of the pump cylinder 6. The clip projection 37 lies in a groove 38 which is created as a result of the cuffing of the bottom 36.

For the passage of the displaced air into the air-passage channel 34 of small volume on the right, said channel has, in downward-directed extension, a vertical transverse slot which, at the same time, is open towards the pump chamber 21 so as to form a pressure-relief opening 39. As soon as the sealing lip 23 of the cuff 22 or piston reaches the pressure-relief opening 39, there is communication with the atmosphere via the back of the piston through inlet-valve passage holes 26 towards the tube cross section 17 which passes at the upper end into the opening 20.

The aforementioned control of the air-outlet opening 36 is assumed by a so-called bicycle valve which is switched into the U-shaped return path of the air. This is a cover body 40 of rubber or similar elastic material or plastic which is in the shape of a section of hose. The cover body 40 is pushed from below onto the pump cylinder 6. The cover body 40 passes into a valve lip 41 of reduced thickness. The valve lip finds its valve-seating surface on the outer surface of the cover tube 35. The end surface 42 of the latter is beveled on the outside. It has an angle of about 45° with tip on top so that the annular, previously free-standing valve lip 41 can be moved below without difficulty upon the mounting of the pump. The end surface 42 terminates—as can be noted particularly clearly from FIG. 7—at a definite distance in front of the end there of the air-passage channel 34. The portion of the valve lip which is raised by the outer surface of the pump cylinder 6 permits the production there, due to the construction in rotational symmetry, of an annular channel 43 whereby the air can escape in the manner of a check valve over the entire circumference of the pump cross section there.

On the end facing away from the valve lip 41 and therefore the upper end, the cover body 40 passes into a fastening collar 44. The collar lies on the end of the threaded connector 11 of the one individual hole 10 and acts there at the same time as annular seal on the said threaded connector 11.

The annular cover of a pump-holding cap, referred to as screw cap 45, developed directly on the pump cylinder 6, extends over the fastening collar 44. The threaded engagement permits a firm tightening of the fastening collar 44 and thus a good seal between pump P and container 1.

Equivalent sealing conditions prevail also in the second individual hole 10 provided with the spray nozzle D, since here, also, an annular seal 46 lies on the end surface of the threaded connector 11, a screw cap 47 being arranged over said seal. The two screw caps 45 and 47 have sawtooth threads, in such a manner that a horizontal flank which receives high forces lying perpendicular to the direction of screwing is present. The external thread of the threaded connector 11 is adapted to this. The air slot in the threaded joint is intended merely to indicate the direction. Of course, the horizontal flanks of the thread contact each other without any gap.

The spray nozzle D is of conventional construction and will be only briefly described. It consists of a pushbutton 48 which actuates a spray valve V3. This button is continued in a central ram 49 which is held under spring load in the basic position. The compression spring acting on it bears the reference number 50 and is seated in an insert part 51, the upper section of which forms a spring chamber for the compression spring 50 while its lower section forms a connection to receive the riser tube 7.

The insert part 51 is clipped into the cover of the centrally interrupted screw cap 47. There is involved here a dish-shaped portion which bears on its top a sealing ring 52 and clamps the latter against the bottom of the cover of the screw cap 47. The hole edge of the sealing ring 52 lies in tightly sealing manner in front of a transverse channel of the ram 49, which transverse channel 43 is connected with an outlet channel 54 in the center of the ram 49. The latter conducts the substance to be dispensed to a nozzle 55.

The central region below the sealing ring 52 is removed and is in flow communication via one or more air channels 56 with the compressed air space of the container 1.

As soon as the pushbutton 48 is depressed, the edge of the hole of the sealing ring 52 leaves the peripheral mouth of the transverse channel 53. Thus, the liquid flowing in within the rise tube 7 can pass, due to the pressure above the surface of the liquid 8, into the delivery path, with the admission of optimally atomizing air via the air channels 56.

Briefly summarized, the operation is as follows: By actuation of the pump handle 14 in the direction indicated by the double-ended arrow z, air is drawn via the inlet-valve passage openings 26 into the pump chamber 21 upon the pulling out of the piston rod 16. This is possible since the cuff 22 or piston lifts with friction lock off from the angular rib 24. The air passes through the passage 27 as well as the incisions 30. Upon reaching the end position, the piston rod is pressed downward.

The rear of the piston applies itself in sealing manner against the annular rib 24. The air enclosed in the pump chamber 21 passes via the pressure-relief opening 39 into the air passage channel 34 which extends in opposite direction, so as to pass into the upper part of the container in the region of the air-outlet valve V2. In corresponding manner, the valve lip 41 lifts off resiliently. Upon reaching the end position, the sealing lip 23 of the piston passes over the pressure-relief opening 39. Due to the communication with the atmosphere, there is immediately a relief of pressure in the pump chamber 21 so that no residual pressure is present which could cause a creeping or springing back of the piston rod 16. After a few pump strokes, sufficient pressure is present and the dispenser Sp is now ready for use.

In the embodiment shown in FIG. 1, in order to bring about the basic position of the dispenser, the topcap 19 which acts there as pump handle 14 need merely be swung into the position shown in dot-dash line in order then to enter into the position shown in FIG. 2.

In the second embodiment the separate top cap bears the reference number 19'.

The optional equipping of the individual holes 10 has already ben discussed in detail in the preamble to the specification.

We claim:

1. A container for the spray dispensing of liquid with a spray nozzle arranged on the top side of the container and a handle for a pump which is associated with the container and has a pump cylinder, piston rod and pump piston driven by the piston rod for producing a cushion of compressed air above the surface of the liquid wherein the pump piston comprises a cuff carried by the piston rod, and the pump cylinder has, on its lower end, a pressure-relief opening, a sealing surface of the cuff being movable past the pressure-relief opening; and said opening is in fluid communication with an outwardly open tube cross section of the piston rod when the pump piston is in its depressed position; and the pump has an encasing tube which is clip-mounted to the pump cylinder and extends around a bottom of the pump to form the bottom of the pump cylinder.

2. A container according to claim 1, further comprising an encasing tube which surrounds the piston cylinder in order to form an air-passage channel from a lower end of the pump up into a region of the upper part of the container terminating there as an air-outlet opening.

3. A container according to claim 2, further comprising a cover on top of the container and an outlet valve beneath the cover;

wherein the air-outlet opening of the air-passage channel is closed by the outlet valve.

4. A container according to claim 3, wherein a portion of the outlet valve is formed as a cover body around the encasing tube.

5. A container according to claim 4, wherein the cover includes a threaded connection of tubular shape and having a central hole for receiving the pump; and the container further comprises a pump holding cap, and the valve cover body has a fastening collar which is clamped between the threaded connection of the cover and the pump-holding cap, the pump-holding cap being screwed onto the threaded connection.

6. A container according to claim 5, wherein the pump handle extends over the pump-holding cap.

7. A container according to claim 5, wherein a housing of the container is elongated in cross section, and has a pair of opposed narrow side roundings; and the pump handle and/or spray nozzle each individually has individual holes which are adapted to be used as filling openings and lie approximately in the centers of the narrow-side roundings of the container.

8. A container according to claim 7, wherein the pump handle and spray nozzle are each provided with a head part which interchangeably fits both of the individual holes.

9. A container according to claim 7, wherein the pump handle comprises a cap disposed on top of the piston rod which is turnable with the piston rod; and the pump-handle cap has a downward open cavity to grip over the spray nozzle.

10. A container according to claim 9, wherein the base surface of the pump-handle cap is developed geometrically similar to a head surface of the container.

11. A container according to claim 4, wherein the valve cover body terminates in a valve lip.

12. A container for the spray dispensing of liquid with a spray nozzle arranged on the top side of the container and a handle for a pump which is associated with the container and has a pump cylinder, piston rod and pump piston driven by the piston rod for producing a cushion of compressed air above the surface of the liquid wherein the pump piston comprises a cuff carried by the piston rod, and the pump cylinder has, on its lower end, a pressure-relief opening, a sealing surface of the cuff being movable past the pressure-relief opening;

said opening is in fluid communication with an outwardly open tube cross section of the piston rod when the pump piston is in its depressed position;

the piston rod is tubular, and the pump further comprises a cap located at an upper end of the piston rod; and a bottom of the cap has an opening for the passage of air drawn in through the tubular piston rod.

13. A container for the spray dispensing of liquid with a spray nozzle arranged on the top side of the container and a handle for a pump which is associated with the container and has a pump cylinder, piston rod and pump piston driven by the piston rod for producing a cushion of compressed air above the surface of the liquid wherein the pump piston comprises a cuff carried by the piston rod, and the pump cylinder has, on its lower end, a pressure-relief opening, a sealing surface of the cuff being movable past the pressure-relief opening;

said opening is in fluid communication with an outwardly open tube cross section of the piston rod when the pump piston is in its depressed position;

the cuff undergoes a relative displacement relative to the piston rod, the displacement being an axial displacement;

the piston rod is tubular and has an air inlet valve opening in a bottom region of the piston rod facing the cuff; and the cuff has a cup shaped cavity with the cup bottom of the cuff closing the inlet-valve opening; closing the inlet-valve opening.

14. A container according to claim 13, wherein the bottom end of the piston rod has a plurality of inlet-valve passage openings which are distributed at equal angles apart.

15. A container for the spray dispensing of liquid with a spray nozzle arranged on the top side of the container an da handle for a pump which is associated with the container and has a pump cylinder, piston rod and pump piston driven by the piston rod for producing a cushion of compressed air above the surface of the liquid wherein the pump piston comprises a cuff carried by the piston rod, and the pump cylinder has, on its lower end, a pressure-relief opening, a sealing surface of the cuff being movable past the pressure-relief opening;

said opening is in fluid communication with an outwardly open tube cross section of the piston rod when the pump piston is in its depressed position;

the cuff has a cup-shaped cavity, and the piston rod has at its lower end a central mandrel terminating in a mushroom-shaped clip projection, the cuff being clipped into the central mandrel of the piston rod by the clip projection;

the mandrel extends through an opening in the cuff into the cavity of the cuff, there being a clearance between the mandrel and the cuff at the opening to provide a passage; and the clip projection has incisions extending to the mandrel wall, the incisions being in fluid communication with the passage.

16. A container according to claim 15, wherein an association of the cuff arranged on the end of the piston rod with the central passage forms an air-inlet valve;

upon relative displacement of the cuff with respect to the piston rod, the cuff forms a sealing surface of the air-inlet valve;

the lower end of the piston rod has an annular rib facing the cuff to form a valve-seat; and the annular-rib has a diameter which is larger than a diameter of the passage.

17. A dispenser for a spray dispensing of a liquid comprising:

a container for holding the liquid;

a spray nozzle disposed on a top side of the container for spraying the liquid;

a pump extending downwardly into the container for developing a cushion of compressed air above a surface of the liquid, the pump having a pump cylinder, a pump piston movable within the pump cylinder, and a piston rod disposed within the pump cylinder for displacing the piston along the cylinder;

wherein the piston rod has a tubular form defining an inner chamber communicating to the exterior of the container;

the pump includes an air passage communicating between a bottom of the piston rod chamber and an exterior region of the piston; and a bypass air passage is disposed in a wall of the cylinder distant from at op of the cylinder, and extending upward to communicate with the exterior region of the piston upon a movement of the piston by the bypass air passage to provide pressure relief.

18. A dispenser according to claim 17, wherein the bypass air passage is located at a bottom end of the pump cylinder.

* * * * *